US009064485B2

(12) United States Patent
Yamauchi

(10) Patent No.: US 9,064,485 B2
(45) Date of Patent: Jun. 23, 2015

(54) TONE INFORMATION PROCESSING APPARATUS AND METHOD

(71) Applicant: Yamaha Corporation, Hamamatsu-shi, Shizuoka-ken (JP)

(72) Inventor: Akira Yamauchi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/198,896

(22) Filed: Mar. 6, 2014

(65) Prior Publication Data

US 2014/0251115 A1 Sep. 11, 2014

(30) Foreign Application Priority Data

Mar. 6, 2013 (JP) ..... 2013-044252

(51) Int. Cl.

| | |
|---|---|
| ***G10H 1/38*** | (2006.01) |
| ***G10H 7/00*** | (2006.01) |
| ***G10H 1/02*** | (2006.01) |
| ***G10H 1/20*** | (2006.01) |
| ***G10H 1/36*** | (2006.01) |

(52) U.S. Cl.

CPC . *G10H 1/38* (2013.01); *G10H 1/02* (2013.01); *G10H 1/20* (2013.01); *G10H 1/36* (2013.01); *G10H 2210/005* (2013.01); *G10H 2210/221* (2013.01); *G10H 2210/395* (2013.01); *G10H 2220/251* (2013.01); *G10H 2210/571* (2013.01)

(58) Field of Classification Search

CPC ..... G10H 2210/225
USPC ..... 84/613, 628
See application file for complete search history.

(56) References Cited

U.S. PATENT DOCUMENTS 4,354,414 A 10/1982 Deutsch et al.
7,271,331 B2 * 9/2007 Lindemann ..... 84/628

FOREIGN PATENT DOCUMENTS

JP 10-193586 A 11/1998
JP 2004-170840 A 6/2004
JP 2007-293373 A 11/2007

OTHER PUBLICATIONS

Anonymous. (Jan. 1, 1988). "Roland MIDI Intelligent Synthesizer, E-20 Owner's Manual,", XP055119974, Osaka, Japan, located at: <URL:http://media.rolandus.com/manuals/E-20OM.pdb , retrieved on May 26, 2014, pp. 1-82.

(Continued)

*Primary Examiner* — Jeffrey Donels
(74) *Attorney, Agent, or Firm* — Morrison & Foerster LLP

(57) ABSTRACT

If a pitch bend event is included in a note event, one tone to be sounded in accordance with the note event continuously varies in pitch from a note pitch designated by the note event to another note pitch, as a result of control response to the pitch bend event. For sounding of a note based on an accompaniment pattern, harmony note or the like, the pitch corresponding to the note event is converted in accordance with a designated chord, and thus, not only the note pitch corresponding to the note event but also the other note pitch responsive to the pitch bend event should be converted appropriately. Thus, arrangements are made for accurately determining the pitch-bend-responsive other note pitch that is not identifiable from the note pitch indicated by the note event itself and converting the other note pitch in accordance with a designated chord.

11 Claims, 5 Drawing Sheets

(56) References Cited

OTHER PUBLICATIONS

Chua, B. Y. et al. (Jan. 4, 2006). "Perceptual Rhythm Determination of Music Signal for Emotion-Based Classification," Multi-Media Modelling Conference, Proceedings, 2006, 12th International Beijing, China, Piscataway, NJ , USA, IEEE, 8 pages.

Extended European Search Report mailed Jun. 20,2014, for EP Application No. 14157742.9, 12 pages.

Pardo, B. et al. (Jan. 1, 1999). "Automated Partitioning of Tonal Music," Proceedings of the International Flairs Conference, XP002458140,Ordered set of partitions points. Segments. Block chords & arpeggiated chords, p. 1, right-hand column; figure 1, pp. 23-27.

* cited by examiner

| TONE INFORMATION NO. | TIMING | PITCH | PITCH END TIMING |
|---|---|---|---|
| 1 | 1:1:000 | C | 1:2:360 |
| (1) | 1:3:000 | E | 1:3:400 |
| (1) | 1:4:000 | G | 2:1:000 |
| 2 | 2:1:000 | E | 2:2:000 |
| 3 | 2:3:000 | C | 2:4:000 |

| TONE INFORMATION NO. | TIMING | PITCH | PITCH VARIATION INFORMATION |
|---|---|---|---|
| 1 | 1:1:000 | C | E(1:3:000), G(1:4:000) |
| 2 | 2:1:000 | E | — |
| 3 | 2:3:000 | C | — |

TONE INFORMATION PROCESSING APPARATUS AND METHOD

BACKGROUND

The present invention relates generally to a tone information processing apparatus and method for converting a pitch (tone pitch) of tone information in accordance with a chord, as well as a storage medium storing a computer-executable program related to the method.

Electronic keyboard instruments have been known which have an automatic accompaniment function (style reproduction function) for converting a pitch of each of notes, which are included in an accompaniment pattern of a plurality of performance parts prestored in accompaniment style data classified per music genre like jazz or rock, in accordance with a chord designated during reproduction. Each accompaniment pattern for use in such an automatic accompaniment function is a pattern created so as to arrange accompaniment notes of pitches based on a desired reference chord. In association with such an accompaniment pattern, a note conversion table is prepared in advance for converting each pitch within the accompaniment pattern into a pitch corresponding to a chord designated during reproduction. More specifically, pitch shift data corresponding to a designated chord type are read out on the basis of the note conversion table, and pitches of individual accompaniment notes included in the accompaniment pattern are converted into pitches corresponding to the designated chord (see Japanese Patent Application Laid-open Publication No. HEI-10-293586 (hereinafter referred to as "Patent Literature 1")).

In the case of timbres or colors of sustained tones, such as certain types of folk instrument tone colors, for example, there is often used an expression that, during a sounding time period of a tone, varies the tone from a certain pitch to another pitch in a continuous manner. In order to create accompaniment pattern data having a realistic performance expression by use of such a sustained-tone color, it is necessary to include, in the accompaniment pattern data, an expression that, during a sounding time period of a given tone, continuously varies the pitch of the tone. However, with the automatic accompaniment function disclosed in Patent Literature 1, it is not possible to include, in accompaniment pattern data, tone information that, during a sounding time period of a given tone, continuously varies the tone from a certain pitch to another by a pitch bend or the like.

More specifically, if the accompaniment pattern includes tone information representative or indicative of a tone continuously varying in pitch by a pitch bend or the like, the pitch conversion technique disclosed in Patent Literature 1 would perform pitch conversion only in accordance with a shift amount corresponding to a note number (pitch) with no regard to the pitch bend or the like instructed halfway through the sounding time period. Thus, the expression of continuous pitch variation by the pitch bend or the like would not match the type of the designated chord. For example, in a case where an accompaniment pattern created on the basis of a C major chord includes a pitch bend that varies a pitch auditorily for four semitones from a C note to an E note, and if a C minor chord has been designated during reproduction, the pitch conversion technique disclosed in Patent Literature 1 can only effect pitch variation auditorily for four semitones from the C note to the E note although a user wants a pitch bend to be performed auditorily for three semitones from the C note to an E flat note.

Further, Japanese Patent Application Laid-open publication No. 2004-170840 (hereinafter referred to as "Patent Literature 2") discloses a technique for continuously varying a pitch in accordance with a designated chord. According to the disclosure of Patent Literature 2, when a pitch of a performance input note is to be automatically converted in accordance with a chord change instruction included in currently reproduced sequence data (automatic performance data), and if the performance input note is of a sustained-tone color, for example, continuous variation from the currently-sounded pitch to another pitch is effected in accordance with the chord change instruction and using for example a pitch bend, without silencing the currently-sounded tone. If, on the other hand, the currently-generated tone is not of a sustained-tone color, then the currently-generated tone is deadened or silenced and then the tone is re-generated after being converted into the other pitch matching the chord change instruction.

According to the technique disclosed in Patent Literature 2, however, only one pitch is associated with a performance input note that functions as a basis of pitch conversion, and no consideration is given at all to a situation where "a performance input note continuously varies from a certain pitch to another pitch during a sounding time period of the input note" or "an expression for continuously varying a performance input note from a certain pitch to another pitch during the sounding time period of the input note is imparted to the input note". Therefore, with the technique disclosed in Patent Literature 2 too, pitch conversion cannot be performed appropriately in accordance with a designated chord in a case where a performance input note continuously varies from a certain pitch to another pitch during the sounding time period of the input note.

Further, Japanese Patent Application Laid-open publication No. 2007-293373 (hereinafter referred to as "Patent Literature 3") discloses a technique for converting pitches of an arpeggio pattern prepared in a waveform data format. According to the technique disclosed in Patent Literature 3, a plurality of data sets are prepared in advance for an arpeggio pattern in association with a plurality of application ranges based on tempos, chord roots (root notes), chord types, etc, and each waveform data set indicative of any one of arpeggio patterns is divided in advance into segments corresponding to individual notes that constitute an arpeggio. Then, an arpeggio pattern (waveform data set) corresponding to user's performance input (user-designated tempo and chord) is read out, and a pitch of each of the segments of the read-out waveform data set is converted in accordance with the designated chord.

However, the technique disclosed in Patent Literature 3 is designed to segment a waveform data set per note included in the arpeggio and never assumes a case where the note continuously varies from a certain pitch to another during the sounding time period of the note. Thus, in a case where a tone (arpeggio component note) continuously varying in pitch during its sounding time period is included in an arpeggio pattern, the technique disclosed in Patent Literature 3, which executes pitch conversion on an arpeggio pattern of the waveform data format in accordance with a chord designated during reproduction of the arpeggio pattern, too cannot appropriately perform pitch conversion on the arpeggio pattern in accordance with a designated chord.

SUMMARY OF THE INVENTION

In view of the foregoing prior art problems, it is an object of the present invention to provide an improved tone information processing apparatus which can appropriately perform, in accordance with a designated chord, pitch conversion on tone information having an expression that continuously varies a tone indicated by the tone information from a certain pitch to another pitch.

In order to achieve the above-mentioned object, the present invention provides an improved tone information processing apparatus, which comprises: a tone information acquisition section configured to acquire tone information indicative of a tone having a pitch element; a chord information acquisition section configured to acquire chord information designating a chord; a determination section configured to determine whether one tone indicated by the tone information, acquired by the tone information acquisition section, continuously varies from a first note pitch to a second note pitch, different from the first note pitch, during a sounding time period of the tone; and a pitch conversion section configured to convert a pitch of the acquired tone information so as to match the chord information acquired by the chord information acquisition section, wherein, when it is determined that the one tone indicated by the tone information continuously varies from the first note pitch to the second note pitch, the pitch conversion section converts the first note pitch and the second note pitch independently of each other so as to match the chord information.

The present invention is characterized in that, in a case where one tone indicated by tone information is to be controlled to vary in pitch over time (i.e., temporally), it clearly determines that the one tone continuously varies from a certain first note pitch to a second note pitch different from the first note pitch during the sounding time period of the tone and converts the first note pitch and the second note pitch independently of each other so as to match the chord information. Thus, the plurality of note pitches included in the temporal pitch variation occurring during the sounding time period of the one tone indicated by the tone information are converted independently of each other to respective appropriate note pitches matching the chord information. Therefore, individual ones of the plurality of note pitches included in the one tone indicated by the tone information can be appropriately converted by respective different intervals in accordance with a type of the chord information. Namely, different pitch conversion can be performed depending on types of chord information; for example, assuming the first pitch corresponds to a root note of a designated chord and the second pitch has four-semitone interval higher than the first note, in the case of a major chord, the first and second pitches are each pitch-converted by a four-semitone interval whereby the second pitch corresponds to a major third note, but, in a minor chord, the first pitch is pitch-converted by a four-semitone interval and the second pitch is pitch-converted by a three-semitone interval whereby the second pitch corresponds to a minor third note.

In the aforementioned manner, the present invention can, for example, include, in an accompaniment pattern data set to be used for an automatic accompaniment function, tone information having a performance expression (e.g., pitch bend) of continuously varying a pitch of a tone indicated by the tone information from a certain note pitch to another note pitch during the sounding time period of the tone. Thus, for example, when creating an accompaniment pattern using a sustained-tone color, such as a certain type of folk instrument tone color, the present invention can impart an accompaniment pattern data set with a performance expression of continuous pitch variation characteristic of a sustained-tone color, such as a folk instrument tone color, so that, in reproduction of the accompaniment pattern data set, the performance expression of continuous pitch variation can be reproduced in a natural or spontaneous manner in accordance with designated chord information.

In one embodiment, the pitch conversion section is configured to realize continuous pitch variation from a converted note pitch of the first note pitch to a converted note pitch of the second note pitch by inserting an intermediate pitch-varying segment between the converted note pitch of the first note pitch and the converted note pitch of the second note pitch. With such an arrangement, it is possible to appropriately simulate a state where a note pitch varies continuously during sounding of a tone.

In one embodiment, the one tone indicated by the tone information has an original intermediate pitch variation characteristic from the first note pitch to the second note pitch, and the pitch conversion section controls a characteristic of the intermediate pitch-varying segment, to be inserted the converted note pitch of the first note pitch and the converted note pitch of the second note pitch, in such a manner as to be similar to the original intermediate pitch variation characteristic. With such arrangements, the present invention allows original intermediate continuous pitch variation characteristics, i.e. pitch variation states (variation shapes of pitch variation elements, such as a pitch variation amount and pitch variation speed) to be maintained in the pitch-converted (i.e., post-pitch-conversion) tone information as in the original. Thus, the present invention can appropriately and faithfully reproduce a pitch variation expression of the pre-pitch-variation tone information even after the pitch conversion, without impairing the expression.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Now, with reference to the accompanying drawings, a description will be given about preferred embodiments of a tone information processing apparatus and a program of the present invention.

Figures 1, 4A, 4B:
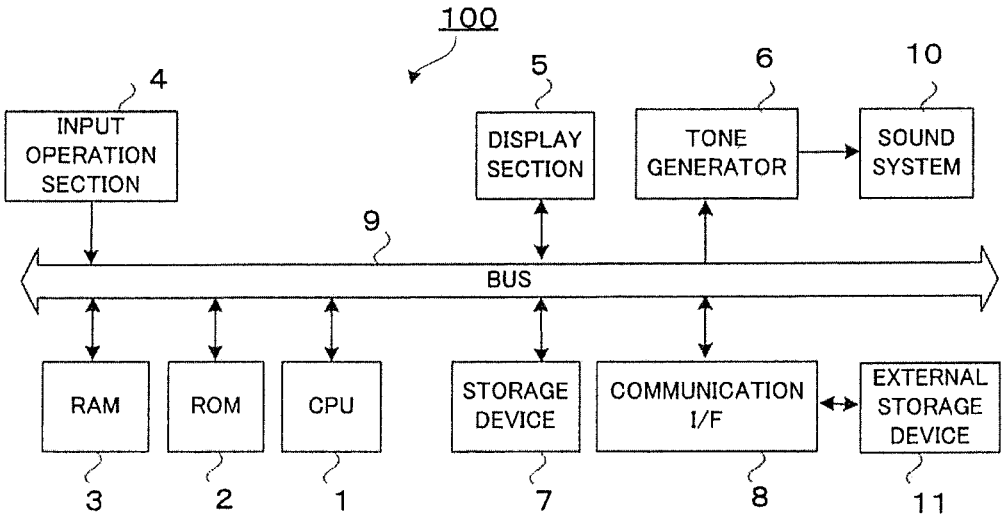
FIG. 1 is a block diagram showing an example electric hardware setup of an electronic musical instrument to which is applied an embodiment of a tone information processing apparatus of the present invention.
FIGS. 4A and 4B are diagrams showing example data formats of associated pitch information based on the accompaniment pattern data set of FIG. 2.

FIG. 1 is a block diagram showing an example electric hardware setup of an electronic musical instrument 100 to which is applied, i.e. which functions as, an embodiment of the tone information processing apparatus of the present invention. The electronic musical instrument 100 is, for example, an electronic keyboard instrument having an automatic accompaniment function (accompaniment style reproduction function), which is configured to convert tone information, acquired from accompaniment pattern data or the like, to match a chord designated during reproduction of the accompaniment pattern data. More specifically, the electronic musical instrument 100 is characterized in that, if the acquired tone information is indicative of a tone that, during a sounding time period of the tone, continuously varies from a leading or first note pitch to another or second note pitch different from the first note pitch, it appropriately converts the tone information, having the continuous pitch variation, to match acquired chord information by converting the first note pitch and second note pitch independently of each other to match the chord. In this specification, "pitch matching a chord", "pitch matched to a chord", "pitch suited for a chord" and the like mean a pitch capable of being used for a melody on that chord, and such a pitch represents a "tension note", not an avoid note, of component notes of the chord and other notes than the chord-component notes. Note that the "avoid note" is a note determined as a dissonance of the chord.

As shown in FIG. 1, the electronic musical instrument 100 includes a CPU (Central Processing Unit) 1, a ROM (Read-Only Memory) 2, a RAM (Random Access Memory) 3, an input operation section 4, a display section 5, a tone generator 6, a storage device 7 and a communication interface (I/F) 8, and these components are interconnected via a data and communication bus 9.

The CPU 1 controls general behavior of the electronic musical instrument 100 by executing programs stored in the ROM 2 or RAM 3. The ROM 2 is a non-volatile memory storing therein various programs for execution by the CPU 1 and various data. The RAM 3 is for use as a loading area of a program to be executed by the CPU 1 and as a working area for the CPU 1.

The input operation section 4 includes a group of operators operable by the user to perform various operations (i.e., operable for receiving various user's operations), and a detection section for detecting operation events of the individual operators. The CPU 1 acquires an operation event detected by the input operation section 4 and performs processing corresponding to the acquired operation event. The operator group may include data inputting operators, such as various switches, and a performance inputting operator, such as a keyboard. Examples of user's operations performed via the input operation section 4 include an accompaniment style selection operation, an automatic accompaniment start operation, various information input operations, a chord input operation, a performance input operation, etc.

The display section 5 comprises, for example, a liquid crystal display panel (LCD), a CRT and/or the like, which can display various information to be used in the electronic musical instrument 100 under control of the CPU 1. Examples of the various information to be displayed on the display section 5 include options of accompaniment style data to be used in an automatic accompaniment, options of sequence data to be used in an automatic performance, and options of a pitch conversion rule.

The tone generator 6 generates a tone signal corresponding to tone information, imparts any of various acoustic effects to the generated tone signals and outputs the effect-imparted tone signal to a sound system 10. The tone information is generated by the CPU 1, for example, on the basis of a performance input entered via the keyboard or the like, later-described accompaniment pattern data, sequence data, etc., and the thus-generated tone information is supplied to the tone generator 6 via the bus 9. The tone generator 6 may employ any desired known tone synthesis method, such as the FM, PCM, physical model tone synthesis method. Further, the tone generator 6 may be implemented by a hardware tone generator device or by software processing performed by the CPU 1 or not-shown DSP (Digital Signal processor). The sound system 10, which includes a DAC, an amplifier, a speaker, etc., converts a tone signal generated by the tone generator 6 into an analog signal and sounds or audibly generates the converted analog tone signal via the speaker etc.

The storage device 7 in the instant embodiment comprises, for example, any of a hard disk, a flexible disk (FD), compact disk (CD), digital versatile disk (DVD) and a semiconductor memory like a flash memory, which is capable of storing various data for use in the electronic musical instrument 100, such as later-described accompaniment style data. Alternatively, the storage device 4 may comprise a semiconductor memory.

The communication interface (I/F) 8 comprises, among other things, a MIDI (Musical Instrument Digital Interface) interface for connection thereto MIDI, a general-purpose interface, such as USB (Universal Serial Bus) or IEEE1394, for connection thereto peripheral equipment, and a general-purpose network interface compliant with the Ethernet (registered trademark) standard or the like. The communication I/F 8 may be constructed to be capable of both wired and wireless communication rather than either of the wired and wireless communication. Via the communication I/F 8, an external storage device 11 is connectable to the electronic musical instrument 100, and the electronic musical instrument 100 is communicatively connectable to a server computer on a communication network.

The electronic musical instrument 100 stores one or more sets of accompaniment style data (accompaniment style data sets) in a desired storage medium, such as the ROM 2, RAM 3, storage device 7 or external storage device 11. These accompaniment style data sets are classified, for example, in accordance with music genres, such as jazz, rock and classic, and each of the accompaniment style data sets has an accompaniment pattern suited for the corresponding music genre. An example of the accompaniment style data sets comprises a plurality of performance parts that include an accompaniment part indicative of, for example, an accompaniment note sequence of an arpeggio pattern, a bass part indicative of a bass line and a drum part indicative of a rhythm pattern, and, in the accompaniment style data set, accompaniment pattern data are prepared in advance for each of the parts. Further, accompaniment pattern data sets of a plurality of sections, corresponding to various scenes such as intro, main, fill-in and ending of a music piece, are prepared in advance for each of the performance parts.

In each of the above-mentioned accompaniment pattern data sets, reference chord information and pitch conversion rule are prestored in association with each other. The reference chord information is indicative of a chord that was used as a reference at the time of creation of the accompaniment pattern in question, and accompaniment notes included in the accompaniment pattern are originally set at pitches matching the reference chord. The pitch conversion rule is provided for converting the pitches of the individual accompaniment notes included in the accompaniment pattern data set so as to match current chord information. Such a pitch conversion rule may itself be a conventionally-known rule (e.g., one disclosed in Patent Literature 1 discussed above), The pitch conversion rule comprises, for example, data of a table format (pitch conversion table). A storage medium storing such a pitch conversion table may be either the same as the one storing the accompaniment style data set, or any other storage medium. Further, the pitch conversion rule may be of other than the table format and may be constructed in a format executing a pitch conversion algorithm corresponding to the pitch conversion table. As the pitch conversion algorithm, there may be applied, for example, an algorithm that converts tones pitches of individual accompaniment notes in the accompaniment pattern to component notes of a designated chord, or an algorithm that, if the individual accompaniment notes in the accompaniment pattern are chord component notes, converts these accompaniment notes directly into component notes of a designated chord and that, if the individual accompaniment notes in the accompaniment pattern are not chord component notes, converts these accompaniment notes into scale notes matching a designated chord.

Further, an application program for implementing the functions of the tone information processing apparatus of the present invention is prestored in a memory (any one of the ROM 2, RAM 3, storage device 7 and external storage device 11) of the tone information processing apparatus, i.e. electronic musical instrument 100, and the above-mentioned CPU (i.e., processor) 1 is configured to execute a group of instruction codes of the application program.

Figure 2:
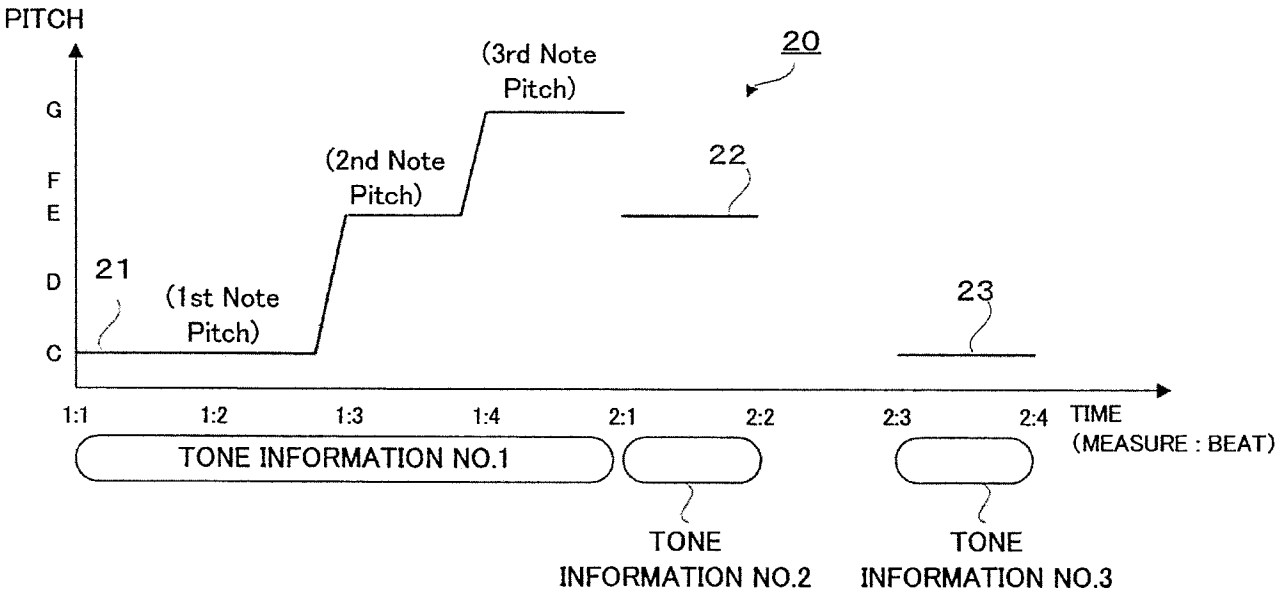
FIG. 2 is a diagrams explanatory of an accompaniment pattern data set for use in an automatic accompaniment function of the electronic musical instrument shown in FIG. 1.

FIG. 2 is a diagram explanatory of an accompaniment pattern data set 20, where the vertical axis represents pitches in pitch names (C, D, E, F, G, . . . ) while the horizontal axis represents time in a "number of measures and number-of-beats" format. The accompaniment pattern data set 20 illustrated in FIG. 2 represents an accompaniment pattern of two measures comprising first tone information ("tone information 1") 21, second tone information ("tone information 2") and third tone information ("tone information 3"). The accompaniment pattern data set 20 is created with a "Cmaj" (C major) chord as the reference chord and comprises the tone information 21, 22 and 23 of pitches matching the "Cmaj" scale and arranged in order of sounding (tone generation) timing.

Further, in FIG. 2, each of notes indicated by the individual tone information 21, 22 and 23 is depicted by a line. A position, on the vertical axis, of such a line indicates a pitch element included in the tone indicated by the corresponding tone information 21, 22 or 23, and a position, on the horizontal axis, of the line indicates a sounding time period (duration) of the tone indicated by the corresponding tone information 21, 22 or 23. Further, the tone information may comprise data in a MIDI data format where a pitch is indicated by note event data, in a waveform data format having specific frequencies and amplitudes, such as PCM waveform data where waveform data itself indicates a pitch element, or microphone input or voice data. In the case where the tone information comprises waveform data, it is set as data of a monophony or unison (two or more parts sounding at a same pitch) with no chord state taken into account.

The first tone information 21 is an example of tone information indicative of a tone that continuously varies from a certain pitch to another during its sounding time period. If the first tone information 21 is in the MIDI format (MIDI data), it comprises a combination of one note event specifically indicating a pitch name of a first note pitch and a plurality of pitch control events indicating that the pitch (first note pitch) indicated by the note event be continuously varied to pitches of other pitch names (second note pitch, third note pitch, . . . ). In the instant embodiment, a pitch bend event is assumed as the pitch control event. However, according to the present invention, the pitch bend event is not limited to a pitch bend event and may be an event for controlling any other type of pitch variation, such as portamento.

In the illustrated example of FIG. 2, the first note pitch, whose specific pitch name has already been known, is assumed to be of pitch name "C" (note "C") while the second and third note pitches whose specific pitch names have been unknown are assumed to be of pitch names "E" and "G" (notes "E" and "G"), respectively. Which specific pitch names the second and third note pitches would take depend on a degree of pitch variation defined by the pitch control event. In the illustrated embodiment, specific pitch names of the second and third note pitches which have been unknown and "start time of continuous pitch variation" among the second note pitch, third note pitch, etc. are determined in accordance with a later-described technique.

Further, in the case where the tone information is in the waveform data format, the tone indicated by the first tone information 21 comprises waveform data of a waveform shape continuously varying from a certain pitch element (first note pitch, i.e. note "C" in the illustrated example of FIG. 2) to other pitch elements (second and third note pitches, i.e. notes "E" and "G" in the illustrated example of FIG. 2) (e.g. waveform data with a pitch bend applied thereto). Generally, in the case where the tone information is in the waveform data format, the first tone information 21 includes no information defining the pitch name of the first note pitch, and thus, it is assumed that the pitch name of the first note pitch and pitch names of the second and third note pitches etc. are acquired through frequency analysis.

Further, in the illustrated example of FIG. 2, the second tone information 22 is an example where a pitch name of a first note pitch is "E", and the third tone information 23 is an example where a pitch name of a first note pitch is "C". These second and third tone information 22 and 23 each do not have an expression of pitch variation dating a sounding time period of a tone (i.e., each do not have the above-mentioned pitch control event as provided in the case where the tone information is in the MIDI format). Further, in the case where the second and third tone information 22 and 23 are in the MIDI format, each of the second and third tone information 22 and 23 comprises one note event indicative of a respective pitch. In the case where the second and third tone information 22 and 23 are in the waveform data format, on the other hand, the second and third tone information 22 and 23 each comprise waveform data of a single pitch that does not have an expression of pitch variation.

Figure 3:
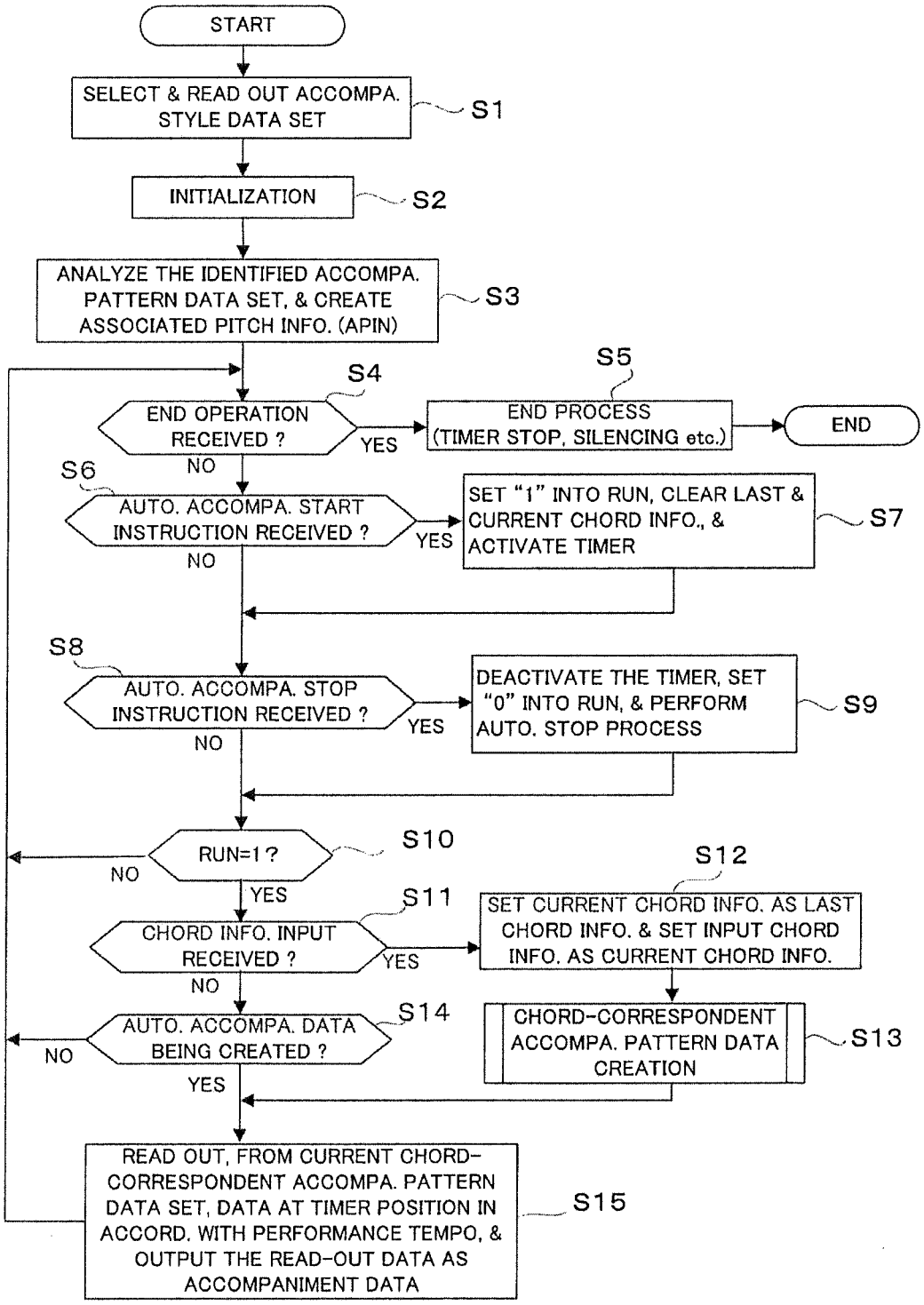
FIG. 3 shows an embodiment of pitch conversion processing of the present invention, which is more particularly a flow chart of automatic accompaniment data creation processing performed by the electronic musical instrument shown in FIG. 1.

Next, a description will be given about processing for outputting automatic accompaniment data created by performing pitch conversion on the tone information included in the accompaniment pattern data set (accompaniment style data) of FIG. 2, as an embodiment of pitch conversion processing of the present invention. FIG. 3 is a flow chart of automatic accompaniment data creation processing for performing an automatic accompaniment using the accompaniment pattern data set (accompaniment style data) of FIG. 2.

The CPU 1 performs the automatic accompaniment data creation processing of FIG. 3, for example, in response to powering-on of the electronic musical instrument 100, an instruction given for starting the automatic accompaniment function in the electronic musical instrument 100, or the like.

Once a user performs an operation for selecting a desired accompaniment style data, the CPU 1 identifies the accompaniment style data set of the user-selected accompaniment style data (selects the accompaniment style data) and reads out the identified accompaniment style data set from the memory storing the accompaniment style data set, at step S1.

At step S2, the CPU 1 performs an initial setting process which includes among other things: identifying, from the selected accompaniment style, one accompaniment pattern data set to be processed; acquiring reference chord information, pitch conversion rule (pitch conversion table or algorithm) and reference tempo information associated with the identified accompaniment pattern data set; initializing settings of current chord information and last chord information; initializing a value of a RUN flag (i.e., setting "0" into the RUN flag); setting a performance tempo; and initializing associated pitch information (APIN). Such construction where the CPU 1 performs steps S1 and S2 functions as a tone information acquisition section configured to acquire tone information indicative of a tone including a pitch element.

At step S3, the CPU 1 analyzes the identified one accompaniment pattern data set to create associated pitch information (APIN) defining a plurality of note pitches pertaining to the accompaniment pattern data set (i.e., constituting tones based on the accompaniment pattern data set) and stores the created associated pitch information into an associated pitch information storage region. Data of the associated pitch information (APIN) comprises a sequence of a plurality of note pitches that are defined in the accompaniment pattern data set and that are temporally associated with each other. More specifically, in the associated pitch information, data indicative of auditory note pitches included in tones (accompaniment notes) indicated by individual tone information in the accompaniment pattern data set and data indicative of respective timing (at least respective sounding start times) of the auditory note pitches are arranged in chronological order. Note that the term "auditory note pitches" used herein embraces not only a note pitch unambiguously or uniquely identifiable by a note event (e.g., the aforementioned first note pitch) but also a note pitch identifiable by analyzing pitch control based on pitch control information (pitch bend event) in the aforementioned manner (e.g., the aforementioned second or third note pitch).

FIGS. 4A and 4B show example data formats of the associated pitch information that are created in different formats on the basis of the accompaniment pattern data set of FIG. 2. In the illustrated examples of these figures, "timing" is indicated by "measure:beat:clock tick" on the assumption that each measure has four beats and each beat is equivalent to 480 clock ticks. Note that the "timing" may be indicated by any other desired unit, such as "hour:minute:second".

According to the data format shown in FIG. 4A, the associated pitch information comprises: tone information numbers identifying the individual tone information in the accompaniment pattern data set; all auditory note pitches included in a tone indicated by each tone information; start timing of the individual auditory note pitches; and end timing of the individual auditory note pitches. The tone information numbers are determined, for example, in order of tone generation timing. In the illustrated example, the tone information number of the first tone information 21 is "1", the tone information number of the second tone information 22 is "2", the tone information number of the third tone information 23 is "3".

If, in the data format of FIG. 4A, the tone indicated by any one of the pieces of tone information has an expression that continuously varies the tone from a certain pitch to another in a sounding time period of the tone (i.e., expression of a pitch bend), the first note pitch and all note pitches included in a result of pitch variation responsive to the pitch bend are determined, independently from one another, as "auditory note pitches" included in the tone indicated by the tone information. For example, for the first tone information 21, three note pitches, i.e. first note pitch "C" and note pitches "E" and "G", included in the pitch variation responsive to the pitch bend are determined as "auditory note pitches". Further, start timing and end timing is determined for each of such auditory note pitches. All of the note pitches included in the tone indicated by the tone information are managed with the same or common tone information number, and which one of the plurality of note pitches is the first note pitch in the tone information in question can be identified on the basis of additional information added to the tone information number (in the figure, parentheses enclosing the numerical value of the tone information number depict the additional information) and start and/or end timing of note pitches preceding and following the note pitch. Further, as the associated pitch information corresponding to the second and third tone information 22 and 23, one note pitch included in the tone indicated by each of the second and third tone information 22 and 23 and start and end timing of the one note pitch are determined.

According to the example data format of FIG. 4B, for each of the pieces of tone information, a first note pitch included in the tone information, start timing of the first note pitch and pitch variation information are determined as the associated pitch information. The pitch variation information is data indicative of continuous pitch variation included in the tone indicated by the tone information, and it comprises all note pitches (scale notes defined in terms of semitones) resulting from pitch variation from the first note pitch responsive to a pitch bend and respective start timing of these note pitches. For example, the associated pitch information corresponding to the first tone information 21 contains, as the pitch variation information, information of pitch names "E" and "G" included in the pitch variation responsive to the pitch bend, and start timing of the note pitches. With the data format of FIG. 4B, the first note pitch and the note pitches as a result of the pitch variation from the first note pitch responsive to the pitch bend can be distinguished from each other on the basis of the pitch variation information. Note that the data format of the pitch variation information may, for example, be a "pointer list" format rather than being limited to the one where the above data are provided for each of the pieces of tone information (tone information numbers). Although each of the note pitches only has start timing information in the illustrated example of FIG. 4B, it may also have pitch end timing information.

Referring back to FIG. 3, the following describe specific examples of the process performed at step S3 for creating the associated pitch information. First, a specific example of the process of step S3 will be described in relation to the case where the accompaniment pattern data set comprises MIDI data (note events and pitch bend events). For each of the pieces of tone information in the accompaniment pattern data set and on the basis of one note event and pitch bend event (note however that the tone information sometimes include no pitch bend event), the CPU 1 reproduces pitch variation over time (i.e., temporal pitch variation) responsive to the pitch bend event and calculates a group of values of all auditory pitches occurring during a sounding time period of the one note event. More specifically, the CPU 1 divides or segments a pitch trajectory in the entire sounding time period of the one note event into given minute time segments along a time axis and calculates an auditory pitch value for each of the minute time segments (e.g., auditory pitch value in cents) to thereby obtain a set of groups of auditory pitch values throughout the sounding time period of the one note event. The thus-calculated auditory pitch values represents a group of varying pitches obtained as a result of controlling the first note pitch (first pitch), corresponding to the note event, in response to the pitch bend event, and these auditory pitch values are represented, for example, in cents (100 cents=one semitone) indicative of respective music intervals from the first note pitch (first pitch). If there is pitch variation during the sounding time period as in the case of the tone indicated by the first tone information 21, a plurality of values varying with variation amounts corresponding to a variation shape (pitch variation) represented by the line 21 in FIG. 2 are calculated along the time axis as a group of auditory pitch values throughout the entire sounding time period. Further, if there is no pitch variation during a sounding time period as in the case of the tone information 22 and 23, a plurality of values substantially constant over the entire sounding time period are calculated as a group of auditory pitch values.

Next, on the basis of the group of calculated pitch values for the one sounding time period, the CPU 1 divides the sounding time period of the corresponding one note event (i.e., tone indicated by the tone information) into a "constant segment" where the pitch remains constant without varying in units of semitones (i.e., the pitch does not vary by one semitone or over) and a "varying segment" where the pitch varies by one semitone or over; that is, the CPU 1 performs an operation for creating segment division information. More specifically, the "constant segment" is where the pitch stays constant at a certain note pitch (of a pitch name defined by semitones) or varies only within a range smaller than a one-semitone interval. In the "varying segment", the pitch continuously varies from a certain note pitch (from a constant segment immediately preceding the varying segment) to another note pitch (to a constant segment succeeding the "varying segment").

More specifically, the CPU 1 first sequentially scans the individual auditory pitch values, calculated in the aforementioned manner, in a temporally forward direction (i.e., forward along the time axis) over the entire sounding time period and thereby ascertains presence of timing (time point) at which the auditory pitch varies by a semitone or over and a direction of such pitch variation. If there has been found pitch variation of a semitone or over as a result of the scanning, the CPU 1 determines whether or not the pitch variation is rapid (discrete) pitch variation. Presence of such pitch variation of a semitone or over can be ascertained by comparing an actual value of the pitch value in question (i.e., pitch value not rounded on a semitone basis (one semitone is 100 cents) and a pitch value obtained by rounding an actual value of the preceding pitch value on the semitone basis (i.e., nominal note pitch prior to the variation, such as the above-mentioned first pitch) and then determining, on the basis of the comparison, whether there is pitch variation equal to or greater than a predetermined threshold value (e.g., value slightly smaller than one semitone, such as 85 cents). The direction of the pitch variation can be determined, for example, by a comparison between the pitch value in question and the actual value of the preceding pitch value (i.e., pitch value not rounded on the semitone basis). Further, the presence of "rapid (discrete) pitch variation" can be determined, for example, by the CPU 1 comparing the actual value of the pitch value in question and the actual value of the preceding pitch value and determining whether there is pitch variation equal to or greater than a predetermined threshold value (e.g., 85 cents). If it has been determined that there is rapid pitch variation, the CPU 1 evaluates a time of the rapid pitch variation as a time at which rapid (discrete) pitch variation of one semitone or over occurs (="occurrence time of discrete pitch variation"). If, on the other hand, it has been determined that there is pitch variation of equal to or greater than the threshold value from the nominal note pitch of the preceding pitch value but this pitch variation is not rapid pitch variation, then the CPU 1 evaluates a time of such pitch variation as an "arrival time of continuous variation" where the pitch continuously varies over one semitone.

If it has been determined that there is pitch variation evaluated as the "arrival time of continuous variation", the CPU 1 scans or checks the pitch values in the temporally backward direction (along the time axis) from the "arrival time of continuous variation" to search for, or find, data that can be guessed as a start time of the continuous variation where the pitch continuously varies over a semitone interval. More specifically, the CPU 1 compares 1) the pitch value currently checked and 2) a value obtained by rounding a pitch value immediately preceding the currently-checked pitch value (in other word, a pitch value "immediately succeeding" the currently-checked pitch value in the temporally forward direction), i.e. a nominal note pitch which the variation has been made to, such as the above-mentioned second pitch, and, if variation equal to or greater than a predetermined threshold value (e.g., 85 cents) has been found, the CPU 1 regards a time of the currently-checked pitch value as the start time of the continuous variation associated with the arrival time of the continuous variation. Let it be assumed that a range over which the CPU 1 checks the pitch values backward along the time axis is a predetermined time range equal to a quantization length. If no data corresponding to the "start time" has been found within the predetermined time range, the CPU 1 may create virtual data to be regarded as the "start time of the continuous variation".

After extracting all "times of discrete variation", "arrival times of continuous variation" and "start times of continuous variation" during the sounding time period of the tone (note event) indicated by the tone information, the CPU 1 divides the sounding time period of the tone indicated by the tone information into "constant segments" and "varying segments" on the basis of these three types of time information and note-on timing included in the note event. The "constant segment" is a sounding time period segment which starts at a "time of discrete variation", "arrival time of continuous variation" or "note-on timing" and ends at a "time of discrete variation" or "start time of continuous variation" that arrives following the start time of the constant segment. The "varying segment", on the other hand, is a sounding time period segment which starts at the "start time of continuous variation" or "arrival time of continuous variation" and ends at an "arrival time of continuous variation" that arrives following the start time of the varying segment, or which starts at the "note-on timing" and ends at an "arrival time of continuous variation" that arrives following the start time of the varying segment.

After determining the "constant segments" and "varying segments" in the aforementioned manner, the CPU 1 performs the following adjustment process. (1) If there is a "varying segment" immediately preceding a "constant segment" of a short time length that does not exceed a predetermined short time length (e.g., time length corresponding to a sixteenth note or semiquaver), the constant segment is absorbed into that preceding "varying segment" immediately preceding the constant segment. Note, however, that such absorption is effected only when a pitch value of the above-mentioned "constant segment" coincides with a pitch value of the end portion of the "varying segment". (2) Two successive "varying segments" (with one "varying segment" immediately preceding the other "varying segment") are integrated into a single "varying segment". Note, however, that such integration is effected only when variation directions of pitch values of the two varying segments are identical to each other. (3) If a "constant segment" immediately follows a "varying segment" which starts at "note-on timing" and ends at an "arrival time of continuous variation", the "varying segment" is absorbed into the "constant segment".

With the above-described detailed arrangements, it is possible to, for example, (1) employ a first pitch (first recognized pitch) at the beginning of a "constant segment (while ignoring continuous variation of an ornamental pitch), (2) employ discrete variation of an ornamental pitch as a "constant segment", (3) if a pitch continuously varies in a discrete manner, employ only a pitch of a first "constant segment" among discrete groups of pitches, and (4) if a pitch varies continuously and if, in front of a "constant segment", there is a portion where a pitch variation direction reverses, employ a pitch of that portion as a pitch of the constant segment.

The CPU 1 determines the "constant segments" and the "varying segments" in the aforementioned manner. Thus, if a tone indicated by any one of pieces of tone information continuously varies in pitch, the CPU 1 can extract, as "constant segments", a segment of a first pitch in the tone information and a segment where a pitch becomes constant at a note pitch, defined in the units of semitones, during pitch variation responsive to a pitch bend. Further, a segment from the beginning between a "constant segment" and another "constant segment" is extracted as a "varying segment". For example, in the case of the first tone information 21 of FIG. 2, a segment from the beginning (0th clock tick) of a first beast of a first measure to a 360th clock tick of a second beat of the first measure is a "constant segment" of the "C" note, a segment from the beginning of a third beast of the first measure to a 400th clock tick of the third beat of the first measure is a "constant segment" of the "E" note, and a segment from the beginning of a fourth beast of the first measure to the beginning of a first beat of a second measure is a "constant segment" of the "G" note. Also, a segment interconnecting adjoining two constant segments is extracted as a "varying segment". Further, in the case of the tone information 22 or 23 including no expression of pitch variation, an entire sounding time period from note-on timing to "note-off" timing is extracted as a single "constant segment".

After determining the "constant segments" and the "varying segments" in the aforementioned manner, the CPU 1 can create associated pitch information as shown in FIGS. 4A and 4B by associating the individual calculated auditory pitch values during the sounding time period and the individual "constant segments" (start timing and end timing of the constant segments). An example of the associated pitch information may be arranged such that, per "constant segment", a pitch (note pitch) obtained by rounding a first pitch value in the constant segment by semitones is stored in association with the constant segment. If a tone indicated by one piece of tone information (e.g., tone information No. 1 shown in FIG. 4A) continuously varies in pitch, a first pitch of the tone and all subsequent note pitches included in pitch variation responsive to a pitch bend are stored in association with the corresponding "constant segment".

The following describe an example of the associated pitch information creation process performed in the case where the accompaniment pattern data set comprises waveform data. First, the CPU 1 calculates, for each of the tone information (waveform data) in the accompaniment pattern data set, groups of auditory pitch values during a sounding time period of a tone indicated by the tone information, by use of a conventionally-known pitch analysis method. Then, the CPU 1 divides the sounding time period of the tone indicated by the tone information into "constant segments" and "varying segments" in a similar manner to the above-described "operation for creating segment division information". Then, the CPU 1 can create associated pitch information as shown in FIGS. 4A and 4B by associating the thus-calculated groups of pitch values with the individual "constant segments".

Note that, after the "constant segments" and "varying segments" are automatically calculated in the aforementioned manner, the user may modify (adjust) the calculated segments. As a modification, "constant segments" and "varying segments" may be manually set or automatically calculated in advance for the accompaniment pattern data set so that associated pitch information can be created at step S3 on the basis of such pre-set or pre-calculated "constant segments" and "varying segments", instead of "constant segments" and "varying segments" being automatically calculated at step S3 through analysis of the accompaniment pattern data set as noted above. This modification allows the CPU 1 to dispense with calculation and determination operations for the division, into segments, of the sounding time period.

The CPU 1 creates the associated pitch information in the aforementioned manner on the basis of the accompaniment pattern data set identified at step S2, and then it stores the created associated pitch information into an associated pitch information (APIN) storage region. Namely, data of the associated pitch information corresponding to the individual tone information in the accompaniment pattern data set are stored into the associated pitch information (APIN) storage region. Then, the CPU 1 makes NO determinations at steps S4, S6, S8 and S10 to perform steps S4 to S10 in a looped manner until an end operation, automatic accompaniment start instruction or automatic accompaniment stop instruction is received from the user.

More specifically, once a user's automatic accompaniment start instruction is received (YES determination at step S6), the CPU 1 goes to step S7, where it sets value "1" into the RUN flag, clears last and current chord information and activates a timer that controls a time progression of an automatic accompaniment. Then, the CPU 1 makes a YES determination at step S10 and determines, at next step S11, whether or not any new chord information input has been received. If no new chord information input has been received as determined at step S11, the CPU 1 performs steps S4 to S14 in a looped manner while awaiting new chord information input.

Using, for example, the input operation section (e.g., keyboard) 4, the user can input chord information designating a chord to be used for reproduction of an automatic accompaniment. Upon receipt of such chord information input (YES determination at step S11), the CPU 1 goes to step S12, where existing current chord information is set as last chord information and the newly-received chord information is set as current chord information. The aforementioned construction where the CPU 1 performs the operations of steps S11 and S12 functions as a chord information acquisition section that is configured to acquire chord information designating a chord. Note that, because the last and current chord information was cleared at step S7, the last chord information is in an initial state (indicating "no chord") at the time of new chord information input.

Then, at step S13, the CPU 1 performs pitch conversion on, or pitch-converts, the accompaniment pattern data set, identified at step S2, on the basis of the current chord information set at step S12 and thereby creates "chord-correspondent accompaniment pattern data set" pitch-converted so as to match the current chord information. A process for creating such a chord-correspondent accompaniment pattern data set will be described in detail later.

At step S15, the CPU 1 reads out, from the chord-correspondent accompaniment pattern data set, data at a time position matching a current timer count value in accordance with a current performance tempo, and then the CPU 1 outputs the read-out data as automatic accompaniment data. Then, if neither new chord information input nor new user's operation input has been received (NO determinations at steps S4, S6, S8 and S11), the CPU 1 performs steps S4 to S15 in a looped manner.

If new chord information input has been input (YES determination at step S11), the CPU 1 updates the last chord information and the current chord information in accordance with the new chord information input (new chord input) at step S12 and creates a "chord-correspondent accompaniment pattern data set" suitable for the new chord input by performing a chord-correspondent accompaniment pattern data creation process at step S13. If an automatic accompaniment stop instruction has been input (YES determination at step S8), the CPU 1 resets the RUN flag to "0" to perform an automatic accompaniment stop process at step S9 and then performs steps S4 to S10 in a looped manner. Further, if an end operation has been input (YES determination at step S4), the CPU 1 performs, at step S5, an end process including a timer stop operation and silencing operation, after which the CPU 1 brings the automatic accompaniment data creation processing to an end.

Figure 5:
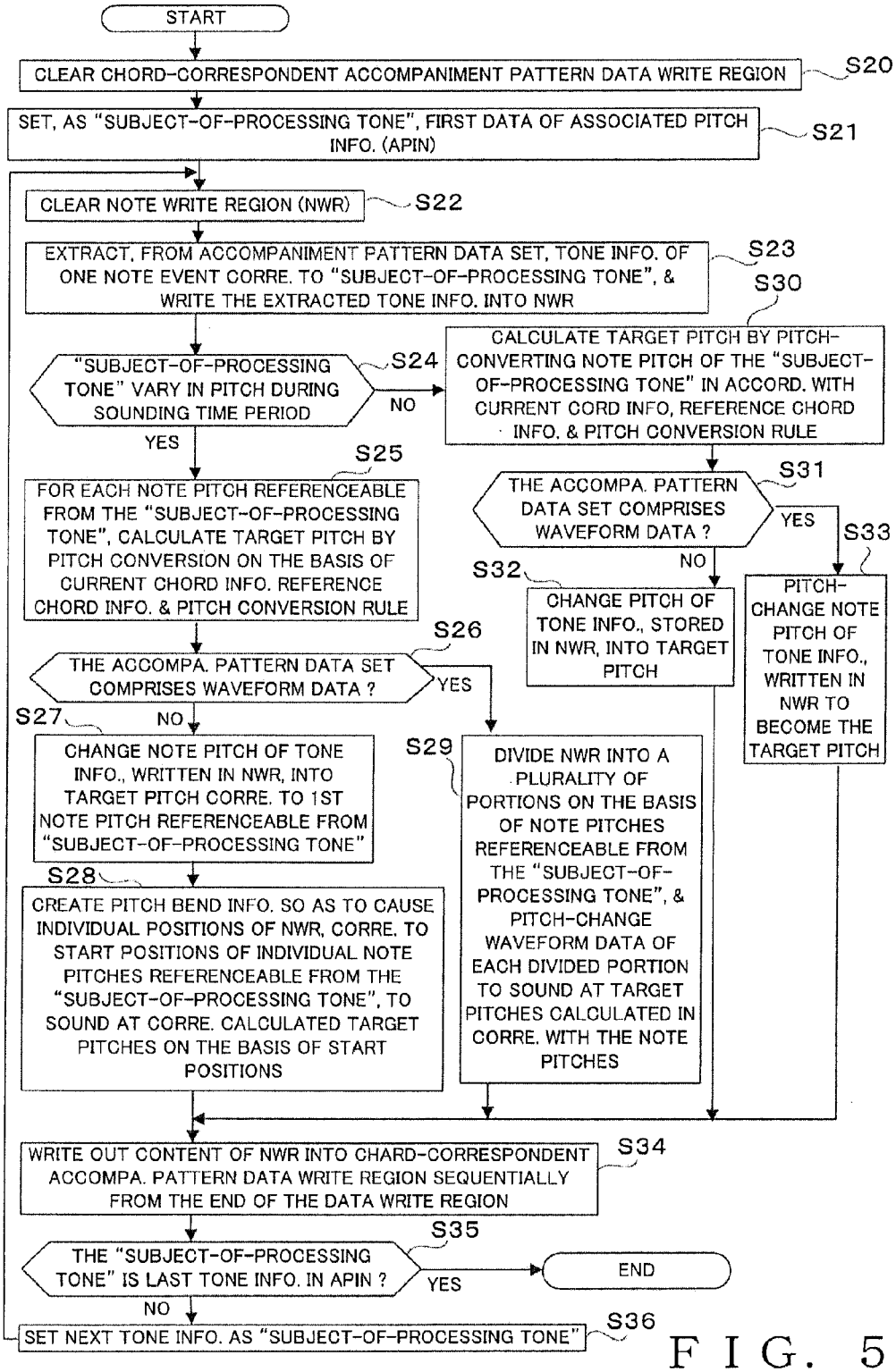
FIG. 5 is a flow chart showing a chord-correspondent accompaniment pattern data creation process in the automatic accompaniment data creation processing of FIG. 3.

FIG. 5 is a flow chart showing the chord-correspondent accompaniment pattern data creation process of step S13. At step S20, the CPU 1 clears a chord-correspondent accompaniment pattern data write region so as to write thereinto a chord-correspondent accompaniment pattern data set created as follows.

At step S21, the CPU 1 sets, as a "subject-of-processing tone", associated pitch information, corresponding to the first tone information, created at step S3 above and currently stored in the associated pitch information (APIN) region. Then, at step S22, the CPU 1 clears a note write region (NWR). At next step S23, the CPU 1 acquires, from the accompaniment pattern data set identified at step S2 above, tone information (MIDI data or waveform data) of one note event corresponding to the "subject-of-processing tone" set at step S21 above (or at later-described step S36), and then it writes the acquired tone information into the note write region (NWR). In the case of MIDI data, examples of the data to be written into the note write region include MIDI event data (i.e., note event data, a plurality of pitch bend event data and expression-imparting MIDI event data such as expression, sostenuto, etc.). In the case of waveform data, examples of the data to be written into the note write region include waveform data corresponding to the tone indicated by the tone information.

At step S24, the CPU 1 makes a determination as to whether the "subject-of-processing tone" set at step S21 above (or at later-described step S36) varies from a certain note pitch to another note pitch during the sounding time period of the tone. The determination as to presence of such pitch variation can be made on the basis of information included in the associated pitch information set as the "subject-of-processing tone" (such as additional information of the tone information number, start or end timing of note pitches preceding and succeeding each of the note pitches, etc. in the illustrated example of FIG. 4A, or presence/absence of pitch variation information in the illustrated example of FIG. 4B).

The above-described construction where the CPU 1 performs steps S3 and S24 functions as a determination section configured to determine whether one tone indicated by the acquired tone information continuously varies from a first note pitch to a second note pitch, different from the first note pitch, during a sounding time period of the tone.

More specifically, the operation of step 24 above (i.e., operation of the determination section) can be arranged to scan temporal pitch variation of the one tone in a temporally forward direction and determines, as an end point of a varying segment, a time point at which pitch variation over an interval of one or more semitones has been detected in accordance with a predetermined threshold value; scan the temporal pitch variation of the one tone in a temporally backward direction from the end point of the varying segment and determine, as a start point of the varying segment, a time point at which pitch variation over an interval of one or more semitones has been detected in accordance with a predetermined threshold value; and determine the first note pitch on the basis of a pitch at the start point of the varying segment and determine the second note pitch on the basis of a pitch at the end point of the varying segment, on the basis of which it is determined that the one tone continuously varies in pitch from the first note pitch to the second note pitch.

According to another aspect, the operation of step 24 above (i.e., operation of the determination section) can be arranged to analyze the temporal pitch variation of the one tone, indicated by the tone information, in order to detect, from the one tone indicated by the tone information, at least two constant segments where different constant note pitches are maintained respectively and at least one varying segment where a pitch continuously varies between the two constant segments. In this case, when the at least two constant segments and the varying segment between the constant segments have been detected, it is determined that the one tone continuously varies in pitch from the first note pitch to the second note pitch.

If the "subject-of-processing tone" varies from a certain note pitch to another note pitch during the sounding time period of the tone (YES determination at step S24) calculates "target pitches" corresponding to the plurality of note pitches included in the associated pitch information set as the "subject-of-processing tone" at step S21 above (or at later-described step S36), by pitch-converting individual ones of the plurality of note pitches independently of each other on the basis of the reference chord information and pitch conversion rule acquired at step S2 above and the current chord information set at step S12 above. The plurality of note pitches included in the "subject-of-processing tone" are, as noted above, the first note pitch of the tone and all note pitches included in a result of pitch variation responsive to a pitch bend, namely, pitches (note pitches) obtained by extracting pitch names, defined in the units of semitones, included in the pitch variation during the sounding time period of the tone. Thus, by the operation of this step S25, all note pitches included in continuous pitch variation can be converted independently of each other into the "target pitches" matched to the current chord information etc. Note that the pitch converting calculations for the individual note pitches may themselves be performed by a conventionally-known method based on reference chord information, pitch conversion rule and current chord information.

If the tone information stored in the note write region comprises MIDI data (NO determination at step S26), the CPU 1 goes to step S27, where it changes the pitch indicated by the note event, stored in the note write region, into a particular "target pitch" corresponding to the first note pitch referenceable in the "subject-of-processing tone" among the plurality of "target pitches" calculated at step S25 above. In the case of the first tone information 21 (tone information No. 1 of FIG. 4), for example, the pitch indicated by the note event stored in the note write region is changed into the "target pitch" calculated in correspondence with the pitch name "C" in tone information No. 1. With such an operation of step S27, the CPU 1 can convert the first note pitch of the tone indicated by the tone information to match the designated chord information.

At next step S28, the CPU 1 creates such groups of pitch bend events as to realize pitch variation indicated by the plurality of "target pitches" calculated at step S25 above. Namely, the CPU 1 creates such groups of pitch bend events as to cause the above-mentioned pitch, indicated by the note event stored in the note write region, to sound at the corresponding target pitches at timing of the second and subsequent note pitches (i.e., note pitches included in the pitch variation responsive to the pitch bend) within the "subject-of-processing tone". Further, at step S28, the CPU 1 erases all the pitch bend events stored in the note write region and stores therefor the newly-created group of pitch bend events into the note write region. Because the group of pitch bend events is created at step S28 as noted above, the CPU 1 can change a pitch bend amount responsive to a pitch bend in accordance with the designated chord.

The construction where the CPU 1 performs the operations of steps S27 and S28 or a later-described operation of step S29 functions as a pitch conversion section configured to convert the pitch of the acquired tone information to match the acquired chord information. If one tone indicated by the tone information continuously varies from a pitch to another pitch, the pitch conversion section converts these pitches independently of each other so as to match the chord information. Thus, it is possible to obtain tone information matching the designated chord while maintaining the same expression of continuous pitch variation as before the pitch conversion. For example, if the designated chord is "C minor", note pitches included in pitch variation responsive to a pitch bend are converted independently of each other so as to match the designated chord "C minor"; for example, the first tone information (pitch "C"→pitch "E"→pitch "G") 21 of FIG. 2 is converted in pitch to "C"→"E-flat"→"G" so as to match the designated chord "C minor".

The following describe a specific example of the operation for creating pitch bend events at step S28. First, for each "constant segment" or "varying segment" of the "subject-of-processing tone", the CPU 1 compares the individual note pitches (pre-pitch-conversion note pitches) included in the "subject-of-processing tone" (associated pitch information of one note event) set at step S21 above (or at later-described step S36) and the corresponding target pitches (post-pitch-conversion note pitch) calculated at step S27 above and thereby calculates respective "offset values" and "multiplication coefficients" for defining amounts of variation from the pre-pitch-conversion note pitches to the post-pitch-conversion note pitches. Then, for each boundary between adjoining "constant segment" and "varying segment", the CPU 1 calculates a pre-pitch-conversion value by rounding a value of pitch bend data at that boundary on the semitone basis (i.e., pre-pitch-conversion pitch bend value). The above-mentioned "offset value" (OFFV) is indicative of an interval (represented in terms of semitones each equal to 100 cents) between the pre-pitch-conversion note pitch and the post-pitch-conversion note pitch, and it has a positive or negative sign. The "multiplication coefficient" is indicative of a pitch variation width ΔP in the "constant segment" or "varying segment", i.e. a ratio between a pre-pitch-conversion value (ΔPb) of a difference (represented in semitones) between a note pitch at the start time point of the segment and a note pitch at the end time point of the segment and a post-pitch-conversion value (ΔPa) of the difference between the note pitch at the start time point of the segment and the note pitch at the end time point of the segment (e.g., "pre-pitch-conversion pitch variation width"/"post-pitch-conversion pitch variation width"=ΔPa/ΔPb). Further, the "pre-pitch-conversion pitch bend value" can be calculated, for example, from a difference between the first pitch (pre-pitch-conversion pitch of the note event) in the "subject-of-processing tone" and the first pitch of each of the segments.

Then, the CPU 1 changes all the pitch bend events in the note write region on the basis of the above-mentioned "offset values", "multiplication coefficients" and "pre-pitch-conversion pitch bend values" and creates a group of new pitch bend events. More specifically, the CPU 1 creates a group of new pitch bend events in a "constant segment" by adding (or subtracting), to or from all the pitch bend events present in the "constant segment", the offset values corresponding to the pitch bend events. Namely, for each of the pitch bend events present in the "constant segment" storing note pitches as the associated pitch information (APIN), the CPU 1 performs, at step S28, an operation of merely uniformly adding (or subtracting), to (or from) a pitch bend value of each of the pitch bend events, the "offset value" corresponding to a variation amount from the note pitch to the "target pitch".

Further, for a "varying segment", the CPU 1 creates a plurality of pitch bend events in the following manner. First, the CPU 1 sets, as an "initial pitch bent value" (PVIN), a "pre-pitch-conversion pitch bend value" at the start time of the "varying segment". The initial pitch bend value (PVBC) is a value obtained by rounding the pre-pitch-conversion pitch bend value at the start time of the "varying segment" on the semitone basis. After setting the initial pitch bend value (PVBC), the CPU 1 changes all the pitch bend events in the "varying segment" in the manner as set forth in items (1) to (4) below. Namely, (1) First, the CPU 1 performs an operation of adding the "initial pitch bend value" (PVIN) to each of time-serial values of the pitch bend events (PV(t)) after inverting the positive/negative sign of the "initial pitch bend value" (—PVIN) in such a manner as to make zero the initial pitch bend value" (i.e., "PV(t)—PVIN"). (2) Then, the CPU 1 multiplies each of the values of the pitch bend events, having been subjected to the above addition operation, by the above-mentioned "multiplication coefficient" (ΔPa/ΔPb) corresponding to the "varying segment" in question. (3) Then, the CPU 1 adds the "initial pitch bend value" (PVIN) to each of the values of the pitch bend events having been subjected to the above multiplication operation. (4) Then, the CPU 1 adds the above-mentioned "offset value" (OFFV), corresponding to the "varying segment" in question, to each of the values of the pitch bend events, having been subjected to the above addition operation. In the aforementioned manner, converted time-serial values (PV'(t)) of the pitch bend events can be obtained. Such operations can be represented by the following mathematical expression:

$$PV'(t)=[(\Delta Pa/\Delta Pb)*(PV(t)-PVIN)+PVIN]+OFFV$$

where * represents multiplication and/represents division.

Namely, for each pitch bend event present in the "varying segment" that is a connecting segment between the pitches stored in the associated pitch information, the CPU 1 performs, at step S28, the addition and multiplication operations as noted at (1) and (4) above such that a pitch variation shape of the "varying segment" presents an analogical change before and after the pitch conversion. With such a sequence of operations, the CPU 1 can control a state of pitch variation in the "varying segment" in such a manner that pitch variation from a certain "constant segment" (i.e., a certain note pitch) to another "constant segment" (i.e., another note pitch) can be natural and continuous. Namely, it is possible to create, for the "varying segment", such a group of pitch bend events as to smoothly interpolate between the note pitches converted independently of each other in accordance with a chord within the continuous pitch variation. Further, because post-pitch-conversion pitch bend events are created by combinations of scaling based on the addition (or subtraction) of the "offset values" and scaling based on the "multiplication coefficient", it is possible to create post-pitch-conversion pitch bend events (PV'(t)) having a characteristic similar to (analogous to) a characteristic (original intermediate pitch variation characteristic) of a pitch bend variation curve (PV(t)) in the original pitch bends.

Note that, at the time of the pitch bend creation at step S28, the CPU 1 returns, to a center value (i.e., value not imparted with a pitch bend effect), the value of the pitch bend event located at the end of the sounding time period of the tone information in the note write region. Further, the values of the pitch bend events are set to not exceed a predetermined pitch bend range. If the calculated values of the group of pitch bend events exceed the predetermined pitch bend range in one direction, then calculations are performed to determine whether the values of the group of pitch bend events can be caused to fall within the predetermined pitch bend range by the first pitch (i.e., pitch of the note event) of the tone information being shifted. If it is determined that the values of the group of pitch bend events can be caused to fall within the predetermined pitch bend range by the first pitch being shifted, the CPU 1 shifts the first pitch and then outputs results of shifting the value of the group of pitch bend events in a direction opposite from the shifted direction of the first pitch. If, on the other hand, it is determined the value of the group of pitch bend events cannot be caused to fall within the predetermined pitch bend range even by the pitch of the tone information being shifted, or if the calculated value of the group of pitch bend events exceed the predetermined pitch bend range in two (i.e., upward and downward) directions, the sounding time period of the tone information is divided into two portions at a time point when the values of the group of pitch bend events exceed the predetermined pitch bend range, and processing is performed separately for each of the divided portions so that the values of the group of pitch bend events can fall within the predetermined pitch bend range.

If the "subject-of-processing tone" continuously varies from a certain note pitch to another note pitch during its sounding time period (YES determination at step S24), and if the tone information stored in the note write region comprises waveform data (YES determination at step S26), the CPU 1 goes to step S29, where it divides the tone information (waveform data) stored in the note write region into a plurality of portions on the basis of respective start timing of pitches (start times of individual "constant segments") included in the "subject-of-processing tone" and then pitch-changes the tone information (waveform data) stored in the note write region so that the waveform data of the individual divided portions can sound at the corresponding target pitches (calculated at step S25 above). Further, as necessary, waveform data interpolation is performed to smoothly connect between the pitches (varying segments). As a specific example of such waveform data interpolation, the CPU 1 calculates differences between the note pitches (pre-pitch-conversion note pitches) included in the "subject-of-processing tone" and the corresponding calculated target pitches (post-pitch-conversion note pitches) and sets the thus-calculated differences as offset information. Then, on the basis of such offset information, the waveform data of each of the divided portions is reproduced in a pitch-shifted state. As a consequence, it is possible to reproduce the tone information (waveform data) at note pitches suited for a designated chord.

If, on the other hand, the "subject-of-processing tone" does not vary from a certain note pitch to another note pitch during its sounding time period (NO determination at step S24), processing for pitch-converting the accompaniment pattern in response to chord input is performed, similarly to the conventionally-known technique (disclosed for example in Patent Literature 1). Namely, at step S30, the CPU 1 calculates a "target pitch" by pitch-converting one pitch included in the "subject-of-processing tone" on the basis of the reference chord information, pitch conversion rule and current chord information. In the case where the accompaniment pattern data set comprises MIDI data (NO determination at step S31), the CPU 1 changes the note pitch of the tone information stored in the note write region into the calculated target pitch, at step S32. In the case where the accompaniment pattern data set comprises waveform data (YES determination at step S31), the CPU 1 goes to step S33, where it pitch-changes the note pitch of the tone information (waveform data) stored in the note write region into the calculated target pitch.

Then, at step S34, the CPU 1 writes out the tone information of pitch-converted to match a currently-designated chord at steps S27 and S28 or step S29, S32 or S33 above, into the chord-correspondent accompaniment pattern data write region sequentially from the end of the chord-correspondent accompaniment pattern data write region. The aforementioned operations at steps S25 to S33 function as a pitch conversion section.

If any of pieces of tone information remains unprocessed in the associated pitch storage region (NO determination at step S35), the CPU 1 goes to step S36, where it sequentially set, as the "subject-of-processing tone", data of associated pitch information corresponding to the unprocessed tone information into the associated pitch storage region. Then, the CPU 1 reverts to step S22 in order to repeat operations at and after step S22. Then, upon completion of processing of all the tone information in the associated pitch storage region (YES determination at step S35), the CPU 1 ends the chord-correspondent accompaniment pattern data creation process.

Whereas the automatic accompaniment data creation processing of FIGS. 3 and 5 has been described above only for one of a plurality of performance parts constituting an accompaniment part data set for convenience of description, the automatic accompaniment data creation processing may be performed for each of the plurality of performance parts. Further, for simplicity of description, the foregoing description has been made assuming that the instant embodiment does not execute a section change of an accompaniment pattern data set, such as insertion of an intro, fill-in, ending etc., or a chord change in the middle of output of one piece of tone information within an accompaniment pattern data set. Description about a user input process has also be omitted. Further, in the description about the chord-correspondent accompaniment pattern data creation process of FIG. 5, an accompaniment pattern of only one performance part is assumed as a subject-of-processing accompaniment pattern data set, for simplicity of description. For processing an accompaniment pattern data set of a plurality of performance parts, it is only necessary to perform the above-described process of FIG. 5 separately for each of the performance parts. Further, for simplicity of description, the chord-correspondent accompaniment pattern data creation processes of FIGS. 3 and 5 have been described as creating only one cycle of automatic accompaniment pattern data and reading out, at step S15 above, such one cycle of chord-correspond accompaniment pattern data in a looped manner. Further, it has been assumed above that the current chord information and reference chord information handled at steps S28 and S30 each has valid chord information set therein; namely, no consideration has been made above of a situation where such current chord information and/or reference chord information handled at steps S28 and S30 has invalid information set therein.

Figure 6:
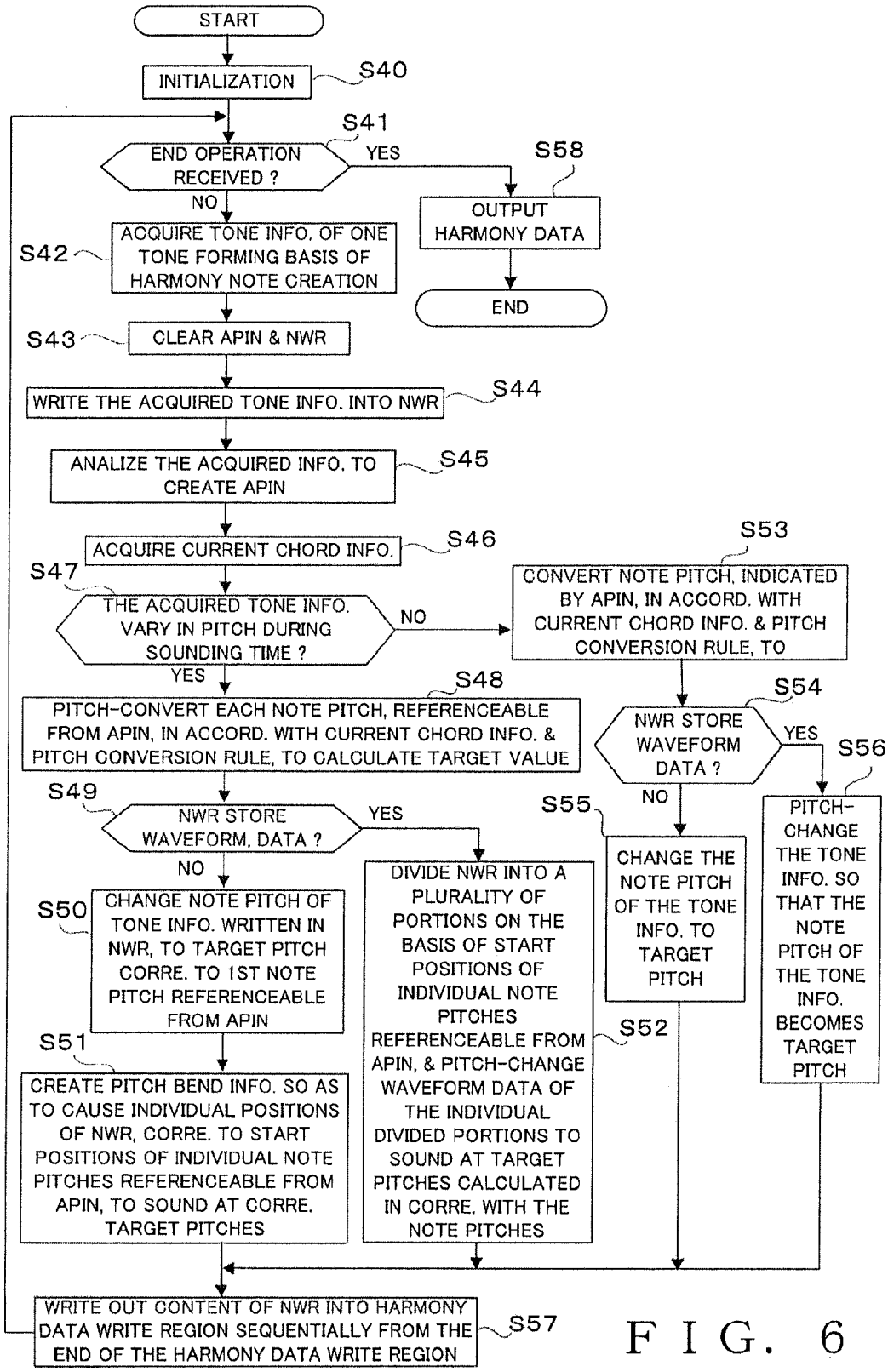
FIG. 6 shows another embodiment of the pitch conversion processing of the present invention, which is more particularly a flow chart of a harmony note creation process in accordance with an embodiment of the present invention.

Next, a description will be given about another embodiment of the pitch conversion processing of the present invention, where harmony notes matching a designated chord are generated per tone information acquired from sequence data. FIG. 6 is a flow chart of a harmony note creation process in accordance with an embodiment of the present invention. The "sequence data" is data having arranged therein a group of pieces of tone information indicative of a melody to be automatically performed. Briefly stated, the harmony note creation process is a process which creates a harmony note by pitch-converting a tone, indicated by each piece of tone information included in sequence data, in accordance with a designated chord and allows the thus-created harmony note matched to the designated chord to be added to a melody note defined by the sequence data. The sequence data can be acquired from a suitable storage medium, such as the storage device 7 or 11, or from a server computer on a network connected to the electronic musical instrument 100 via the communication IX 8. The tone information included in the sequence data is constructed similarly to the tone information included in the aforementioned accompaniment pattern data set (see FIG. 2) and may comprise data in the MIDI data format where a note pitch is indicated by note event data, or in the waveform data format where waveform data itself indicates a pitch element. Let it be assumed here that the sequence data is monophonic data with no chord state data. Further, the harmony note creation process of FIG. 6 is not a real-time process and is designed to acquire tone information, forming a basis of harmony notes to be generated, from the sequence data sequentially one by one in order of sounding timing.

The harmony note creation process of FIG. 6 is started up, for example, in response to a harmony-note-creation-function start instruction, a sequence-data-reproduction-function (automatic-performance-function) start instruction or the like. First, at step S40, the CPU 1 performs an initial setting process which includes among other things: acquisition of a pitch conversion rule; initialization of current chord information; initialization of tone information indicative of a tone currently processed (i.e., a tone that is a current subject of processing, or subject-of-processing tone); associated pitch information (APIN) corresponding to the subject-of-processing tone; and initialization of a note write region (NWR) for writing thereinto tone information indicative of a pitch-converted tone and a harmony data write region for storing created harmony data. Unless an end operation is received, the CPU 1 makes a NO determination at step S41 to repetitively perform operations at and after step S42.

At step S42, the CPU 1 acquires, from the sequence data to be reproduced, tone information indicative of a tone of a note event and forming a basis of harmony note creation. The construction where the CPU 1 performs the operation of step S42 functions as the above-mentioned tone information acquisition section configured to acquire tone information indicative of a tone having a pitch element. Such tone information is acquired from the sequence data sequentially one by one in the order of sounding timing. At next step S43, the CPU 1 clears the associated pitch information (APIN) write region and the note write region (NWR). At step S44, the CPU 1 writes the tone information acquired at step S42 into the note write region. Then, at step S45, the CPU 1 analyzes the tone information written in the note write region as above and thereby creates associated pitch information corresponding to the tone information. Because the associated pitch information write region and the note write region are cleared at step S43, data retained as the associated pitch information in the harmony note creation process of FIG. 6 is only the associated pitch information corresponding to the tone to be sounded. The harmony note creation process of FIG. 6 is different from the above-described process where associated pitch information corresponding to a plurality of pieces of tone information included in an accompaniment pattern data set is created as shown in FIGS. 3 and 5, in that associated pitch information is generated per tone information of a single tone to be generated. Note that details of the process for creating associated pitch information are similar to those set forth in relation to step S3 above.

At step S46, the CPU 1 acquires chord information that is designated, for example, in response to user's performance input. Such construction where the CPU 1 performs the operation of step S46 functions as a chord information acquisition section.

At step S47, the CPU 1 determines, on the basis of the created associated pitch information, whether or not the subject-of-processing tone varies from a certain note pitch to another note pitch during its sounding time period. Such construction where the CPU 1 performs step S3 and S47 functions as the above-mentioned determination section configured to determine whether or not the one tone indicated by the acquired tone information continuously varies from a certain first note pitch to another or second note pitch during its sounding time period. If the tone indicated by the acquired tone information continuously varies from the first note pitch to the second note pitch during its sounding time period (YES determination at step S47), the CPU 1 goes to step S48, where the CPU 1 pitch-converts each of a plurality of note pitches included in the created associated pitch information on the basis of the current chord information and the pitch conversion rule and thereby calculates "target pitches" corresponding to the plurality of note pitches. Such operations are similar to the aforementioned operation of step S25 of FIG. 5, except that the "reference chord information" is not used.

If the tone information stored in the note write region comprises MIDI data (NO determination at step S49), the CPU 1 goes to step S50, where it changes a pitch indicated by a note event stored in the note storage region to one of the calculated "target pitches" that corresponds to a first note pitch of the created associated pitch information. Then, at step S51, the CPU 1 creates such a group of pitch vend events as to realize pitch variation indicated by the plurality of "target pitches", and it erases all the pitch bend events stored in the note write region and stores therefor the newly-created group of pitch bend events into the note write region. The operations of these steps S50 and S51 are similar to the aforementioned operations of steps S27 and S28 of FIG. 5. Such construction where the CPU 1 performs the operations of steps S50 and S51 or later described step S52 functions as the pitch conversion section configured to convert the pitch of the tone, which is to be sounded in accordance with the acquired tone information, to match the acquired chord information. If the one tone to be generated in accordance with the tone information continuously varies from the first note pitch to the second note pitch, the pitch conversion section (S50 and S51, S52) the first note pitch and the second note pitch are converted independently of each other so as to match the chord information.

If the subject-of-processing tone varies from a certain note pitch to another note pitch during its sounding time period (YES determination at step S47), and if the tone information stored in the note write region comprises waveform data (YES determination at step S49), the CPU 1 goes to step S52, where it divides the tone information (waveform data) stored in the note write region into a plurality of portions on the basis of respective start timing (start times of individual "constant segments") included in the generated associated pitch information and then pitch-changes the tone information (waveform data) stored in the note write region so that the waveform data of the individual divided portions can sound at the corresponding target pitches. This operation is similar to the aforementioned operation of step S29 of FIG. 5.

If the subject-of-processing tone dose not vary from a certain note pitch to another note pitch during its sounding time period (NO determination at step S47), the CPU 1 goes to step S53, where it pitch-converts one tone included in the associated pitch information on the basis of the current chord information and the pitch conversion rule to thereby calculate a "target pitch". Further, if the accompaniment pattern data set comprises MIDI data (NO determination at step S54), the CPU 1 changes the pitch indicated by the note event stored in the note write region to the calculated target pitch, at step S55. Further, if the accompaniment pattern data set comprises waveform data (YES determination at step S54), the CPU 1 pitch-changes the tone information (waveform data) stored in the note write region so that the pitch of the tone information in the note write region becomes the calculated target pitch, at step S56. The operations of these steps S53 to S56 are similar to the aforementioned operations of steps S30 to S33 of FIG. 5.

At step S57, the CPU 1 writes out the tone information, rewritten in the note write region at steps S50 and S51, step S52, S55 or S56 above, into the harmony data write region sequentially from the end of the harmony data write region. Such tone information written out from the note write region into the harmony data write region is indicative of a "harmony note" obtained by pitch-converting the subject-of-processing tone in accordance with a designated chord. Then, the CPU 1 performs steps S41 to S57 in a looped manner until a user's end operation is received. In this manner, a harmony note matched to the currently designated chord is created for each of tone information of sequential note events included in the sequence data. Upon receipt of the user's end operation (YES determination at step S41), the CPU 1 exits out from the loop of steps S41 to S57 and outputs the harmony data written in the harmony data write region, at step S58. Thus, the harmony notes matched to the chord can be imparted to the sequence data through not-shown reproduction processes of the sequence data and harmony notes. Thus, even where a melody note corresponding to one tone in the sequence data has continuous pitch variation during its sounding time period, it is possible to create and output a harmony note starting at another note pitch matched to a designated chord, while maintaining the pitch variation state of that melody note.

As set forth above, the present invention is constructed in such a manner that, if any one tone indicated by tone information continuously varies from a certain first note pitch to another or second note pitch during its sounding time period, the first note pitch and the second none pitch are converted independently of each other so as to match chord information. With such arrangements, the present invention can convert all note pitches, included in pitch variation occurring during a sounding time period of a single tone, independently of each other so as to match acquired chord information. Further, by connecting between the converted note pitches with a continuous and natural pitch variation shape, the present invention allows continuous pitch variation states (variation shapes of pitch variation elements, such as a pitch variation amount and pitch variation speed) to be maintained in the pitch-converted (i.e., post-pitch-conversion) tone information. Thus, the present invention can appropriately reproduce a pitch variation expression of the pre-pitch-variation tone information even after the pitch conversion without impairing the expression. Therefore, even if any tone information includes more than one note pitch variation, the present invention can appropriately pitch-convert each of the note pitches in the tone information in accordance with a designated chord.

Thus, for example, the present invention can include, in an accompaniment pattern data set to be used for the automatic accompaniment function, tone information having an expression (e.g., pitch bend, portamento, waveform data having a performance expression, or the like) continuously varying from a certain note pitch to another note pitch during a sounding time period of a single tone. Thus, for example, when creating an accompaniment pattern using a sustained-tone color, such as a certain type of folk instrument tone color, the present invention can impart an accompaniment pattern data set with a performance expression of continuous pitch variation characteristic of a sustained-tone color, such as a folk instrument tone color, with the result that, in reproduction of the accompaniment pattern data set, the performance expression of continuous pitch variation can be reproduced in a natural or spontaneous manner in accordance with designated chord information.

Note that the detailed calculation procedures for creating associated pitch information at step S3 of FIG. 3 and at step S45 of FIG. 6 and the detailed calculation procedures performed at steps S27, S28 and S29 of FIG. 5 and at steps S50, S51 and S52 of FIG. 6 "for, when the tone information includes an expression of pitch variation, converting all pitches to be sounded in accordance with the expression of pitch variation" are merely illustrative, and any other suitable calculation procedures or methods may be applied.

Further, tone information to be pitch-converted (i.e., subject-of-pitch-conversion tone information) in the example processing of FIGS. 3, 5 and 6 has been described above as prestored tone information. However, if a delay in output of a result of the pitch conversion is permitted, a modification may be made such that, each time subject-of-pitch-conversion tone information is input in real time, pitch conversion responsive to the input and output of a result of the pitch conversion may be executed with some time delay as necessary. Alternatively, the output of the result of the pitch conversion may be temporarily stopped during the pitch conversion that likely to cause a time delay. Namely, upon detection of the start of one or more continuous pitch variation included in tone information of a tone to be sounded, the output of the result of the pitch conversion may be temporarily stopped, and then the output of the result of the pitch conversion pertaining pitch variation included in the tone information may be resumed upon detection of the end of the pitch variation of the tone.

Furthermore, whereas subject-of-pitch-conversion tone information in the processing of FIGS. 3, 5 and 6 has been described above as read out from accompaniment pattern data or sequence data stored in a storage medium, it may be read out from accompaniment pattern data or sequence data acquired from a server on a network connected to the electronic musical instrument (tone information processing apparatus) via the communication I/F 8. Alternatively, such subject-of-pitch-conversion tone information may be input in real time via the input operation section (keyboard) 4 or external audio input (such as a microphone) and then processed sequentially or temporarily stored for subsequent sequential processing.

Furthermore, whereas the embodiment of the present invention has been described above in relation to the case where chord information is input (or designated) by user's performance input (keyboard operation), a train of prestored chord information may be sequentially read out, or chord information may be detected from accompaniment pattern data or sequence data.

As a modification of step S13 of FIG. 3, "chord-correspondent accompaniment pattern data sets" may be created and stored in association with individual ones of all usable chords at a time point when an accompaniment pattern data set to be used has been identified at step S2, so that, once a chord is input, one of such "chord-correspondent accompaniment pattern data sets" that corresponds to the input chord is read out at step S13.

The harmony note creation process of FIG. 6 may be arranged in any desired manner, such as by creating harmony notes to a manual performance, instead of being limited to creating harmony notes on the basis of sequence data, as long as it creates harmony notes on the basis of some melody data.

Furthermore, whereas the tone information processing apparatus applied to the electronic musical instrument has been described above, the tone information processing apparatus of the present invention may be implemented by a general-purpose computer or computing device, such as a personal computer or electronic equipment having a computing function, that is installed with a program for causing the general-purpose computer or the computing device to perform the behavior and functions of the tone information processing apparatus of the present invention.

This application is based on, and claims priority to, JP PA 2013-044252 filed on Mar. 6, 2013. The disclosure of the priority application, in its entirety, including the drawings, claims, and the specification thereof, are incorporated herein by reference.

What is claimed is:

1. A tone information processing apparatus comprising:

a tone information acquisition section configured to acquire tone information indicative of a tone having a pitch element;

a chord information acquisition section configured to acquire chord information designating a chord;

a determination section configured to determine whether one tone indicated by the tone information, acquired by said tone information acquisition section, continuously varies from a first note pitch to a second note pitch, different from the first note pitch, during a sounding time period of the tone; and a pitch conversion section configured to convert a pitch of the acquired tone information so as to match the chord information acquired by said chord information acquisition section, wherein, when it is determined that the one tone indicated by the tone information continuously varies from the first note pitch to the second note pitch, said pitch conversion section converts the first note pitch and the second note pitch independently of each other so as to match the chord information.

2. The tone information processing apparatus as claimed in claim 1, wherein said pitch conversion section is configured to realize continuous pitch variation from a converted note pitch of the first note pitch to a converted note pitch of the second note pitch by inserting an intermediate pitch-varying segment between the converted note pitch of the first note pitch and the converted note pitch of the second note pitch.

3. The tone information processing apparatus as claimed in claim 2, wherein the one tone indicated by the tone information has an original intermediate pitch variation characteristic from the first note pitch to the second note pitch, and said pitch conversion section controls a characteristic of said intermediate pitch-varying segment, to be inserted between the converted note pitch of the first note pitch and the converted note pitch of the second note pitch, in such a manner as to be proportional to the original intermediate pitch variation characteristic.

4. The tone information processing apparatus as claimed in claim 1, wherein said determination section is configured to:

scan temporal pitch variation of the one tone in a temporally forward direction and determine, as an end point of a varying segment, a time point at which pitch variation over an interval of one or more semitones has been detected in accordance with a predetermined threshold value;

scan the temporal pitch variation of the one tone in a temporally backward direction from the end point of the varying segment and determine, as a start point of the varying segment, a time point at which pitch variation over an interval of one or more semitones has been detected in accordance with a predetermined threshold value;

determine the first note pitch on a basis of a pitch at the start point of the varying segment and determine the second note pitch on a basis of a pitch at the end point of the varying segment; and determine whether the one tone continuously varies in pitch from the determined first note pitch to the determined second note pitch.

5. The tone information processing apparatus as claimed in claim 1, wherein said determination section is configured to analyze temporal pitch variation of the one tone, indicated by the tone information, in order to detect, from the one tone indicated by the tone information, at least two constant segments where each constant segment has a non-varying pitch and at least one varying segment where a pitch continuously varies between the two constant segments, and wherein, when the at least two constant segments and the varying segment between the constant segments have been detected, said determination section determines that the one tone continuously varies in pitch from the first note pitch to the second note pitch.

6. The tone information processing apparatus as claimed in claim 1, wherein the tone information comprises note event data designating individual tones, and, for each of at least one of the note event data, a pitch control event is associated with the note event data, said determination section determines whether, in a note event indicated by the one note event data, a pitch to be controlled by the pitch control event associated with the note event continuously varies from the first note pitch to the second note pitch, and said pitch conversion section converts at least one of the first and second note pitches so as to match the chord information by converting the pitch control event.

7. The tone information processing apparatus as claimed in claim 1, wherein the tone information comprises waveform data having a specific frequency and amplitude, said determination section determines whether the frequency of the waveform data corresponding to one tone continuously varies from the first note pitch to the second note pitch, and said pitch conversion section converts at least one of the first and second note pitches so as to match the chord information by partly converting the frequency of the waveform data.

8. The tone information processing apparatus as claimed in claim 1, wherein the tone information comprises information indicative of an accompaniment note based on accompaniment pattern data, and said pitch conversion section converts a pitch of the accompaniment note, based on the accompaniment pattern data, in accordance with the chord information.

9. The tone information processing apparatus as claimed in claim 1, wherein the tone information comprises melody data, and said pitch conversion section converts a pitch of a note, based on the melody data, in accordance with the chord information to generate a harmony note based on the pitch-converted note.

10. A pitch converting method comprising:

a tone information acquisition step of acquiring tone information indicative of a tone having a pitch element;

a chord information acquisition step of acquiring chord information designating a chord;

a determination step of determining whether one tone indicated by the tone information, acquired by said tone information acquisition step, continuously varies from a first note pitch to a second note pitch, different from the first note pitch, during a sounding time period of the tone; and a pitch conversion step of converting a pitch of the acquired tone information so as to match the chord information acquired by said chord information acquisition step, wherein, when it is determined that the one tone indicated by the tone information continuously varies from the first note pitch to the second note pitch, said pitch conversion step converts the first note pitch and the second note pitch independently of each other so as to match the chord information.

11. A non-transitory computer-readable storage medium storing a pitch converting program executable by a computer, said program comprising:

a tone information acquisition step of acquiring tone information indicative of a tone having a pitch element;

a chord information acquisition step of acquiring chord information designating a chord;

a determination step of determining whether one tone indicated by the tone information, acquired by said tone information acquisition step, continuously varies from a first note pitch to a second note pitch, different from the first note pitch, during a sounding time period of the tone; and a pitch conversion step of converting a pitch of the acquired tone information so as to match the chord information acquired by said chord information acquisition step, wherein, when it is determined that the one tone indicated by the tone information continuously varies from the first note pitch to the second note pitch, said pitch conversion step converts the first note pitch and the second note pitch independently of each other so as to match the chord information.

* * * * *